US009666050B2

(12) United States Patent
Wu et al.

(10) Patent No.: US 9,666,050 B2
(45) Date of Patent: May 30, 2017

(54) FOREST FIRE EARLY-WARNING SYSTEM AND METHOD BASED ON INFRARED THERMAL IMAGING TECHNOLOGY

(75) Inventors: Jiping Wu, Guangdong (CN); Yuenian Li, Guangdong (CN)

(73) Assignee: GUANGZHOU SAT INFRARED TECHNOLOGY CO. LTD., Guangdong (CN)

( * ) Notice: Subject to any disclaimer, the term of this patent is extended or adjusted under 35 U.S.C. 154(b) by 401 days.

(21) Appl. No.: 14/131,900

(22) PCT Filed: Jun. 5, 2012

(86) PCT No.: PCT/CN2012/000770
§ 371 (c)(1),
(2), (4) Date: Jan. 9, 2014

(87) PCT Pub. No.: WO2012/167609
PCT Pub. Date: Dec. 13, 2012

(65) Prior Publication Data

US 2014/0192184 A1 Jul. 10, 2014

(30) Foreign Application Priority Data

Jun. 9, 2011 (CN) ..... 2011 1 0154786

(51) Int. Cl.
*G08B 17/12* (2006.01)
*G08B 17/00* (2006.01)
(Continued)

(52) U.S. Cl.
CPC ..... *G08B 17/125* (2013.01); *G08B 17/005* (2013.01); *G08B 29/26* (2013.01); *A62C 3/0271* (2013.01); *G08B 25/14* (2013.01)

(58) Field of Classification Search
CPC .. A62C 3/0271; G08B 17/005; G08B 17/125; G08B 25/14; G08B 29/26
See application file for complete search history.

(56) References Cited

U.S. PATENT DOCUMENTS 5,959,589 A * 9/1999 Sadovnik ..... H01Q 3/04 343/757
2004/0183021 A1 9/2004 Luck et al.
(Continued)

FOREIGN PATENT DOCUMENTS

CN 101046908 A * 10/2007 ..... G08B 17/005
CN 201051286 Y 4/2008
(Continued)

*Primary Examiner* — Mohammed Rahaman
(74) *Attorney, Agent, or Firm* — Stoel Rives LLP

(57) ABSTRACT

A forest fire early-warning system based on infrared thermal imaging technology includes an infrared camera erected in a forest to capture infrared thermal images of an area being monitored. The camera includes a frontal temperature detection and alarm module for calculating the alarm temperature value by using a temperature monitoring mathematical model, and for transmitting an excessive temperature alarm signal when there are abnormalities in said area. A video conversion device connected to the infrared camera converts an infrared thermal image analog signal outputted by the camera into an infrared digital signal, and receives from the camera said alarm signal and converts same into a digital signal. A monitoring computer generates and transmits an infrared camera control signal, and processes the infrared digital signal to ascertain the location in the monitoring area that triggered the infrared camera alarm.

17 Claims, 4 Drawing Sheets

(51) Int. Cl.

| | |
|---|---|
| ***G08B 29/26*** | (2006.01) |
| *G08B 25/14* | (2006.01) |
| *A62C 3/02* | (2006.01) |

(56) References Cited

U.S. PATENT DOCUMENTS

| | | | | |
|---|---|---|---|---|
| 2005/0001729 | A1* | 1/2005 | Garmer | G08B 25/10 340/577 |
| 2007/0000317 | A1* | 1/2007 | Berti | G08B 17/005 73/170.16 |
| 2009/0060260 | A1* | 3/2009 | Hou | G06K 9/00771 382/100 |
| 2010/0117839 | A1* | 5/2010 | Lee | G08B 17/125 340/577 |

FOREIGN PATENT DOCUMENTS

| | | | | |
|---|---|---|---|---|
| CN | 101650866 | A | 2/2010 | |
| CN | 101719300 | A | 6/2010 | |
| WO | WO 91/09390 | * | 6/1991 | G08B 17/005 |
| WO | 2006007859 | A2 | 1/2006 | |

* cited by examiner

FOREST FIRE EARLY-WARNING SYSTEM AND METHOD BASED ON INFRARED THERMAL IMAGING TECHNOLOGY

TECHNICAL FIELD

The present application relates to the technical fields of environmental monitoring technology applications, and more particularly relates to a system and method for alarming forest fire based on an infrared imaging technology.

BACKGROUND

Nowadays, both infrared imaging technology and infrared temperature measurement technology are applied to the technical field of automatic forest fire alarm system and their related fields. The way to achieve it is to use an infrared camera as a surveillance camera platform to receive infrared rays from a targeted object and to transform the infrared radiation from the surface of the targeted object into video signals to form video images; then a specific software analyses and captures the hottest temperature spot of the said video images; finally, the system compares the hottest temperature spot with the preset alarm temperature and alarms while the hottest temperature spot surpasses the preset temperature spot.

The present infrared excessive temperature surveillance and alarm technology achieves imaging and alarm through comparing the variation of the temperature of the monitored region and captures the hottest spot of the screen. When the device detects the hottest spot which is higher than that of the preset parameter, the alarm will yield warning signals.

However, the monitoring method for forest fire detection and alarm has its own intrinsically distinction from general environmental surveillance. The hottest temperature alarm arithmetic existed does not suffice the requirement of forest fire detection. The main reasons are as follows: 1. the long range and extensive region of monitoring for forest fire detection call for extremely severe technical requirement of infrared monitor equipment. But due to the remote distance, there are possible unavoidable temperature measurement errors which could lead to the incorrect detected hottest temperature value. 2. The environment for forest fire surveillance is very complicated. Owing to different seasons, day/night temperature differences, North or South latitude and the varieties of geography and topography, the regional or the whole climate of the monitored area thus become unpredictable and filled with variables, so that it is difficult to deduce or generalize its changing trends. It is supposed that this should directly leads to the oscillation of the parameter which can be used as the temperature alarm because the referenced figure would be affected to be plus or minus due to the change in temperature or climate caused by different seasons, alternate day and night, regional latitudes. However, since the particular figure is not easy to be set randomly, it results in the difficulty in precise temperature measurement and alarm by infrared monitoring devices.

SUMMARY

In order to overcome the current deficiencies of the infrared temperature measurement technology in forest fire detection; this invention discloses a brand new system and method for alarming forest fire based on infrared imaging technology. This technology adopts more applicable practical applications for forest fire monitoring and the temperature monitoring mathematical model and its algorithm which suffices to a higher extent the particular requirement for forest fire detection and early-warning. The algorithm can automatically modify the temperature alarm value with different environment temperatures. The temperature alarm value can vary with the changes of temperature due to different climate and seasons etc. to ensure alarming precisely by the alarm system so that the system can eradicate the probability of the forest fire at utmost extent to avoid economic and human losses caused by unexpected fires.

To achieve the foregoing goal, certain embodiments of the present application provides a forest fire alarm system based on infrared imaging technology, which comprising: an infrared camera erected at the apogee of the land area needed for monitoring and early fire warning in a forest for capturing infrared thermal images of the said area, and for transmitting the infrared thermal analog signals which contains the temperature measurement value T relating to the infrared thermal images of the monitored area, and wherein the infrared camera has a frontal temperature measurement and alarm module for calculating, based on the changes of environmental temperature parameters such as distance, temperature difference and alternate seasons, an alarm temperature value $T_{alarm}$ which interprets these changes by using a built-in temperature monitoring mathematical model, and for transmitting excessive temperature alarm signals when there is an emergence of abnormality; a video conversion device connected to the infrared camera for transforming the infrared thermal image analog signals transmitted by the infrared camera into infrared digital signals for standard network transmission, and for receiving and converting the excessive temperature alarm signals outputted from the infrared camera into digital signals; A monitoring computer for generating and outputting control signals to control the infrared camera, and for receiving, analyzing and processing the said infrared digital signals to ascertain the location in the monitoring area that triggered the infrared camera alarm based on the excessive temperature alarm digital signals received by it.

According to certain embodiments of the present application, wherein the frontal temperature measurement and alarm module further comprising an alarm unit in which it holds a temperature monitoring mathematical model for calculating, based on the said model and the said temperature measurement value T, in order to determine: a preset alarm temperature $T_{set}$ either set as a constant value or a variable constant value based on both statistical values of temperature measurement and fire temperature in the monitored area; an isothermal allowed width δt either set as a constant temperature difference value or a variable temperature difference value based on both statistical values of temperature measurement and fire temperature in the monitored area; a reference area S set based on the monitoring parameter of the infrared camera (1) and its mounted area. The minimum area of the reference area should be the monitoring area monitored by a pixel of the infrared camera (1), while the maximum one be the full-screened area; and an average temperature of the reference area $T_S$ automatically captured from the monitored pictures of the Reference area S; and a hottest temperature spot $T_h$ automatically captured based on the real-time monitored pictures of the monitored area and its temperature measurement value T, wherein: alarm temperature value $T_{alarm}$=average temperature of the reference area $T_S$+isothermal allowed width δt.

According to some embodiments of the present application, the condition for alarming the anomaly is: when the hottest temperature spot $T_h \geq$alarm temperature value $T_{alarm}$, the frontal temperature measurement and alarm module 11 alarms; and when the hottest temperature spot $T_h \geq$preset alarm temperature $T_{set}$, the frontal temperature measurement and alarm module 11 alarms.

According to some embodiments of the present application, wherein, the frontal temperature measurement and alarm module comprising in sequence the lens, detector, AD plates and pseudo colored plates. Wherein the said pseudo colored plates further comprising a temperature measurement unit and the alarm unit, wherein, the temperature value T measured by the temperature measurement unit is transmitted to the alarm unit for being calculated to gain the alarm temperature value $T_{alarm}$ by using the temperature monitoring mathematical module in the alarm unit, the alarm unit also outputs the excessive temperature alarm signals of the anomaly to the video conversion device.

According to some embodiments of the present application, wherein the system further comprising: a CCD camera fixed in the vicinity of the infrared camera for capturing visible images of the monitored area and for transmitting the visible image analog signals relating to the visible images of the monitored area, wherein: the said video conversion device for being connecting to the said CCD camera and for transforming the visible image analog signals from the CCD camera into visible digital signals which can be transmitted through standard network; wherein the monitoring computer also for generating and outputting the control signals to control plural the said CCD cameras, and for receiving the said visible digital signals, and for combining the received visible digital signals and infrared digital signals for analyzing and processing so as to alarm an anomaly and to ascertain the location where a danger situation is triggered.

According to some embodiments of the present application, the shooting orientation of the infrared camera and the CCD cameras changes with the operating of the pan-tilt which is installed and integrated with the infrared camera and the CCD cameras. The pan-tilt couples to the said video conversion device through 485 serial ports so as to realize the data communication between them.

According to some embodiments of the present application, the system further comprising: a casing for covering the infrared camera and visible camera and their internal powers respectively integrated into the casing.

According to some embodiments of the present application, wherein, the video conversion device further comprising: a network data conversion unit for transforming analog signals emitted by cameras into digital signals for standard network transmission wherein the cameras contain the infrared camera and the CCD camera while the analog signals include infrared imaging analog signals and visible imaging analog signals, and the digital signals encompass infrared digital signals and visible signals; and a pan and tilt control unit for transforming a pan-and-tilt control signals from a network into 485 serial ports control signals in order to control a corresponding pan and tilt to operate and to receive the status of the pan and tilt through 485 serial ports, and then to transmit these information to the monitoring computer.

According to some embodiments of the present application, the monitoring computer comprising: a data input interface for receiving digital signals transiting from the video conversion device and; a data analysis module for intercepting and analyzing the digital signals from the data input interface by using forest fire disaster analysis and process software and for determining and locating the fire area within the monitoring region based on the processed data and for generating the pan and tilt control signals to control the infrared camera and the visible camera.

According to some embodiments of the present application, the monitoring computer further comprising: a storage module for storing the processed data and the determined conclusion; and a display module for directly displaying infrared video pictures, fire triggering places and recommending disposal solutions within the monitoring region.

According to some embodiments of the present application, wherein, the data input interface of the monitoring computer transmits the data and does network communication with the video conversion device through EPON optical chain circuit.

According to some embodiments of the present application, wherein, the frontal temperature measurement and alarm module further comprising: IR lens, detector, AD plates and pseudo colored plates for achieving precise far distance infrared image capture and temperature measurement within the monitored region.

According to some embodiments of the present application, wherein the system further comprising: a switcher or HUB for being connected to the video conversion device by network cables so as to achieve the network communication between the two.

To achieve the foregoing object, some embodiments of this application further provides a method for forest fire alarm system based on infrared imaging technology thereon, its application is akin to any one of the aforementioned forest fire alarm system, wherein, the method comprises the following steps: S1) starts the infrared camera 1, CCD 5 and the video conversion device 2 which are mounted at the woodland commanding heights of area needed the fire monitoring for capturing infrared thermal images and visible images; S2) receives the pan and tilt control signals from the monitoring computer 3 through either wireless or network cable communication so as to control the shooting orientation of the infrared camera 1 and the visible camera 5; S3) calculates and obtains the alarm temperature value $T_{alarm}$ by using the frontal temperature measurement and alarm module (11) based on the application of temperature monitoring mathematical model so as to output the excessive temperature alarm signals of the anomalies; S4) transmits in real-time the infrared image analog signals which contains the temperature measurement value T, visible image analog signals as well as the excessive temperature alarm signals to the video conversion device (2) thereon. The video conversion device (2) transforms them into the digital signals and outputs to the monitoring computer (3); S5) the monitoring computer (3) intercepts and analyzes the received digital data by utilizing the built-in forest fire analysis and process software; S6) the monitoring computer (3), based on the foregoing analysis, pinpoints the fire triggering area and alarms on excessive temperature when receiving the excessive temperature alarm signals, otherwise, back to S2.

According to some embodiments of the present application, wherein in step S3, the frontal temperature measurement and alarm module (11), based on its built-in temperature monitoring mathematical module and the temperature measurement value T, computes to determine: a preset alarm temperature $T_{set}$ either set as a constant value or a variable constant value based on both statistical values of temperature measurement and fire temperature in the monitored area; isothermal allowed width $\delta t$ which is a constant temperature difference value or a variable temperature difference value set based on the temperature measurement statistical value and the fire risk temperature statistical value; a reference area S which is set based on the monitoring reference of the infrared camera and the install location of which the minimum size of the reference area should be the monitoring area of one pixel of the infrared camera while the maximum one the monitored area of full-screen monitoring picture of the infrared camera; and average temperature of reference area $T_S$ is the average temperature automatically captured within the reference area S based on the monitored pictures of the foregoing reference area S; and hottest spot temperature $T_h$. is automatically captured based on the real time monitoring pictures of the monitored region and the temperature measurement value T within those pictures, wherein alarm temperature value $T_{alarm}$=average temperature of reference area $T_S$+isothermal allowed width δt.

According to some embodiments of the present application, wherein, the condition for alarming aimed at the said anomaly is: when the hottest spot temperature value $T_h \geq$alarm temperature value $T_{alarm}$, the frontal temperature measurement and alarm module (11) will alarm on excessive temperature; and when the hottest spot temperature value $T_h \geq$preset alarm temperature value $T_{alarm}$, the frontal temperature measurement and alarm module (11) will alarm on excessive temperature.

According to some embodiments of the present application, the method for alarming forest fire based on infrared imaging technology further comprises steps as follows: S7) After having executed S7, the monitoring computer (3) will visualize pictures of danger of the monitored area, relative data and the attempted disposal solution which will be automatically stored into the storage module and/or the forest fire analysis treatment software so as to do the post-fire analysis and treatment.

The present application possesses merits as below:

1) The present application solves the problem of difficulty in setting the alarm temperature value as an unchangeable constant due to the perplexed and variable monitored environment for forest fire detection.

2) The present application puts forward a brand new vague algorithm of which the alarm parameter can be automatically adjusted to the environment to achieve the goal of automatically alarm with the distance, time and season, which meets the requirement of alarming within the monitored area for forest fire.

3) The infrared camera (its frontal temperature measurement and alarm module) of this present system adopts the frontal temperature measurement and alarm module of G95 which is newly-developed by SATIR (Guangzhou SAT Infrared Technology Co. Ltd.), wherein, the frontal temperature measurement and alarm module comprises the IR lens, detectors, AD plates and pseudo colored plates. Wherein the said pseudo colored plates further comprises a temperature measurement unit and an alarm unit in order to achieve the requirement of precision for capturing infrared image and temperature measurement from afar and to calculate based on the build-in temperature monitoring mathematical module an alarm temperature value $T_{alarm}$ which is more applicable to forest fire surveillance.

WHEREIN REFERENCE SIGNS ARE EXPLAINED AS BELOW

1—Infrared camera
- 11—Frontal temperature measurement and alarm module

2—Video conversion device
- 21—network data conversion unit
- 22—pan and tilt control unit

3—Monitoring computer
- 31—data input interface
- 32—data analysis module
- 33—storage module
- 34—display module

4—Switcher or HUB

5—Visible camera

6—Casing

DETAILED DESCRIPTION OF PREFERRED EMBODIMENTS

The foregoing and other objects, aspects and advantages of the present application will become more apparent from the following detailed description of the embodiments in the present application taken in conjunction with the preferred embodiments and accompanying drawings. The embodiments here are only used to illustrate but not to limit the present application.

Any one of the infrared cameras depends on the change of temperature to achieve their goal of imaging, temperature measuring and alarming. And the temperature change of the monitored object (the forest) has close relation to the distance, temperature difference from day to night and season alternation. The conventional infrared monitoring technology or algorithm would only provide a constant preset temperature alarm value (at least remain unchangeable in certain intervals) which can be used as a parameter to compare it with the literally measured temperature value. If the latter is higher than the former, then an alarm is triggered. To meet the requirement of monitoring an excessive big area for an excessive long time in the forest, the current infrared monitoring devices all possess such a technical blind spot, i.e. it is necessary to preset a parameter as the preset temperature alarm value which can change correspondingly to the change of environment, but the fact is that they can't create a precision parameter formula or parameter value (e.g. how much is temperature alarm value in the morning? How much at noon? How much in summer and how much in winter?) to adjust to or exhibit the change.

A brand new temperature monitoring mathematical module and an improved algorithm according to an embodiment of the present application calculates, referred to the environmental temperature parameter based on the change of distance, temperature difference and season alteration, the temperature alarm value which presents the foregoing change. Based on the temperature alarm value, an embodiment of this present application achieves the goal of excessive temperature alarm within the preset isothermal allowed width.

Figure 1:
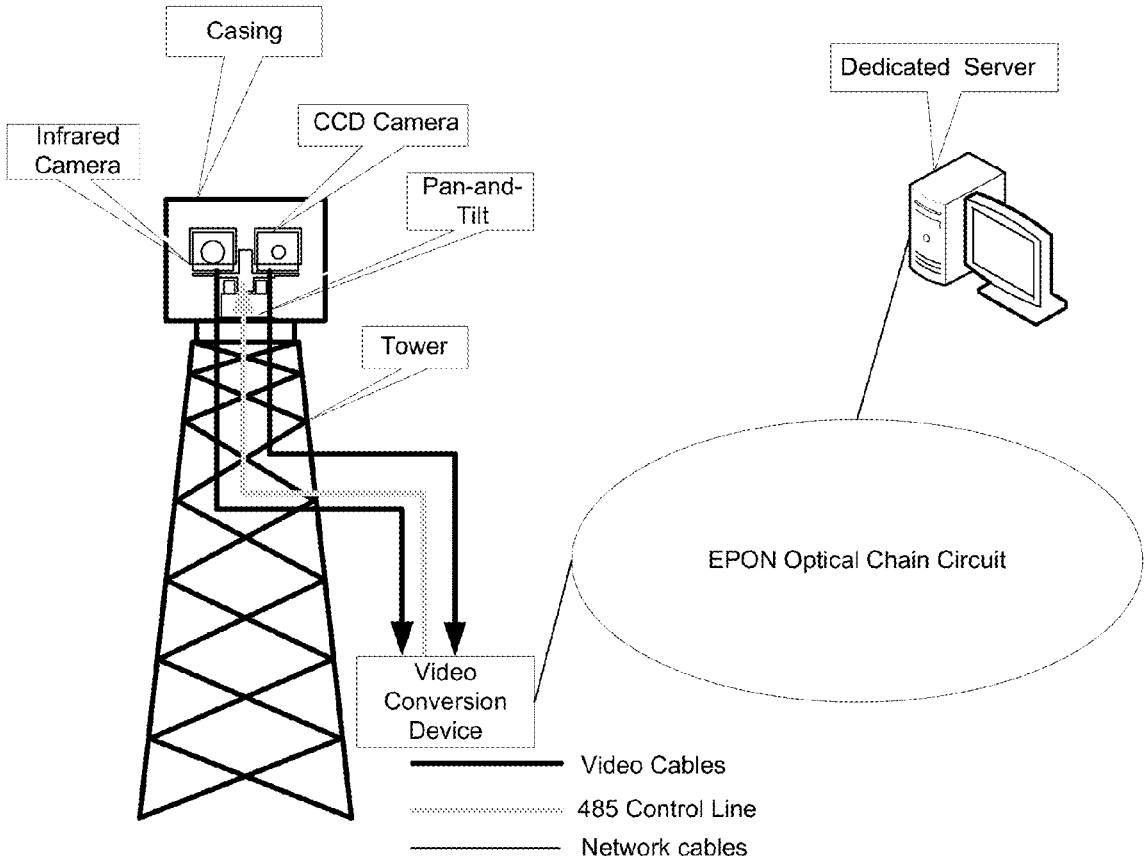
FIG. 1 is a configuration diagram showing a forest fire alarm system according to an embodiment of the present application.
Figure 2:
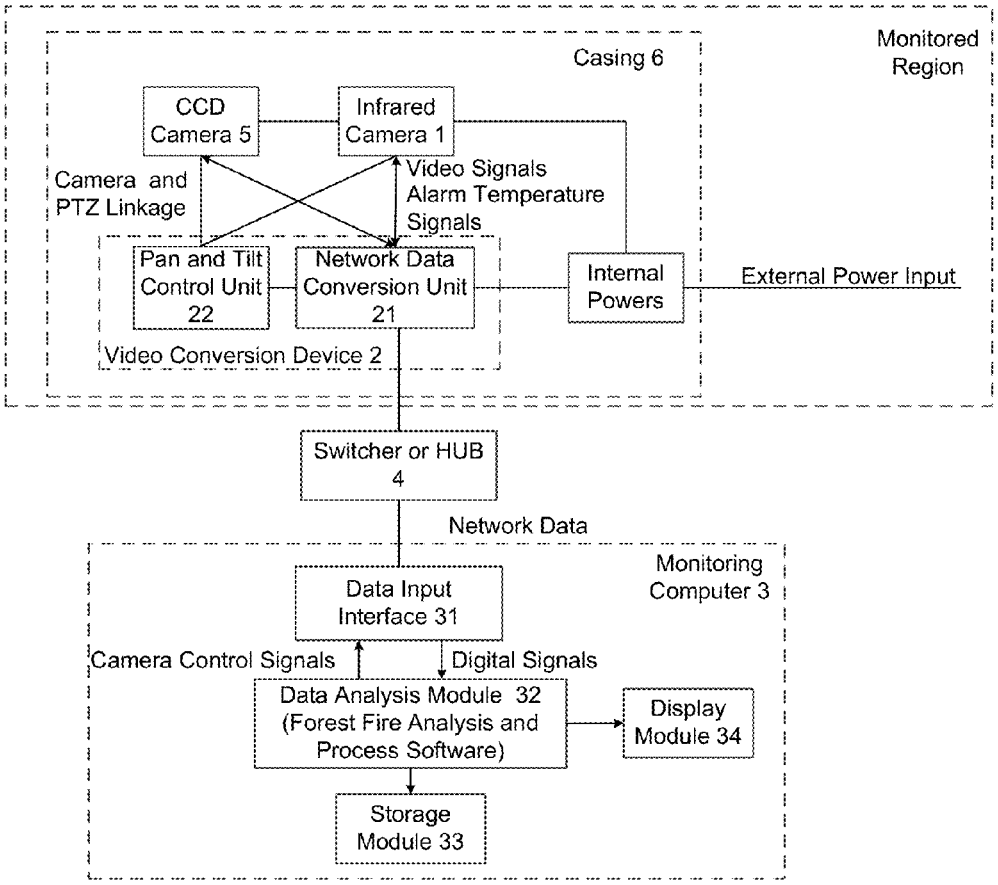
FIG. 2 is a block diagram showing a forest fire alarm system to an embodiment of the present application.

FIG. 1 is a configuration diagram showing the forest fire alarm system. FIG. 2 is a block diagram showing the forest fire alarm system according to this embodiment of the present application.

As FIG. 1 demonstrated, the forest fire alarm system according to an embodiment of the present application, wherein equipment like an infrared camera, pan and tilt and its powers are installed on a tower at the apogee of the land area needed for monitoring and early fire warning in a forest for capturing infrared thermal images (monitoring video pictures) of a specific area or the whole forest and for outputting infrared imaging analog signals relating to infrared images which include the temperature measurement value T of the monitored region. Wherein the system further comprises a video conversion device used to transform video data into network-transmitted digital signals and a dedicated server (monitoring computer) arranged at the rear headquarters for forest fire detection. The dedicated server connects with the video conversion device through network-transmitted device like EPON optical chain circuit.

As FIG. 2 demonstrated, wherein, the infrared camera 1 of the forest fire alarm system comprises a frontal temperature measurement and alarm module 11 which obtains a temperature alarm value $T_{alarm}$ by using its built-in temperature monitoring mathematic module and outputs an excessive temperature alarm while an anomaly exhibits. The video conversion device 2 connects with the infrared camera 1 and transforms the infrared image analog signals from the infrared camera 1 into infrared digital signals for standard network transmission and receives the excessive temperature alarm from the infrared camera 1 and transforms the signals into digital signals; the monitoring computer 3 is used to generate and output control signals to control the infrared camera 1 and to receive the infrared digital signals for further analyzing and elaborating. The monitoring computer 3, after receiving the digital excessive temperature alarm signals, determines the risk location based on the analysis.

Figure 3:
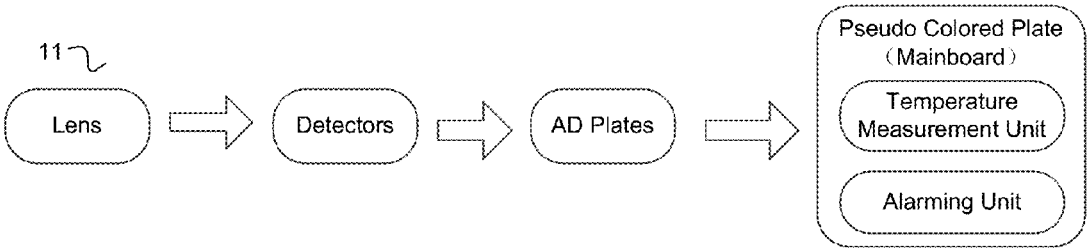
FIG. 3 is a schematic diagram showing the frontal temperature measurement and alarm module of the infrared camera according to an embodiment of the present application.

Referred to FIG. 3, wherein the frontal temperature measurement and alarm module 11 comprises in sequence the IR lens, detectors, AD plates and pseudo colored plates. Wherein the said pseudo colored plates further comprises a temperature measurement unit and an alarm unit, wherein, the temperature T measured by the temperature measurement unit is transmitted to the alarm unit, wherein, the built-in temperature monitoring mathematical module of the alarm unit calculates to gain the alarm temperature value $T_{alarm}$ and outputs the excessive temperature alarm signals of the anomaly to the network data conversion unit 21 of the video conversion device 2. The frontal temperature measurement and alarm module 11 of some embodiment of the present application could adopt G95 of SATIR (Guangzhou SAT Infrared Technology Co. Ltd.), the latest achievement of this company, which is able to realize the goal of precisely capturing infrared images distance away and measuring temperature and to calculate the temperature alarm value $T_{alarm}$ which is more applicable to monitor to warn forest fires.

Wherein the alarm unit includes a temperature monitoring mathematical module. To calculate based on the temperature monitoring mathematical module and the temperature measurement value T to determine:

A preset alarm temperature $T_{set}$ either set as a constant value or a variable constant value based on both statistical values of temperature measurement and fire temperature in the monitored area;

An isothermal allowed width δt either set as a constant temperature difference value or a variable temperature difference value based on both statistical values of temperature measurement and fire temperature in the monitored area;

A reference area S set based on the monitoring parameter of the infrared camera 1 and its mounted area. The minimum area of the reference area should be the monitored area monitored by a pixel of the infrared camera 1, while the maximum one should be the full-screened area monitored by the infrared camera 1; and An average temperature of the reference area $T_S$ automatically captured from the monitored pictures of the reference area S; and A hottest temperature spot $T_h$ automatically captured based on the real-time monitoring picture of the monitored area and its temperature measurement value T, wherein:

Alarming temperature value $T_{alarm}$=average temperature of the reference area $T_S$+isothermal allowed width δt.

Wherein, the condition for excessive temperature alarm while there is anomaly lies in:

When the hottest temperature spot $T_h \geq$alarm temperature value $T_{alarm}$, the frontal temperature measurement and alarm module 11 alarms; and When the hottest temperature spot $T_h \geq$preset alarm temperature $T_{set}$, the frontal temperature measurement and alarm module 11 alarms.

According to some embodiments of the present application, the system may further comprises a CCD camera 5 located in the vicinity of the infrared camera 1 in order to capture the visible images of the monitored region and to output visible image analog signals relating to the visible images of the monitored region. Wherein, the video conversion device 2 connects with the CCD camera 5 and transforms the visible image analog signals from the CCD camera 5 into standard network-transmitted digital visible signals; and the monitoring computer 3 generates and outputs control signals to control plural the said CCD camera 5. Furthermore, the monitoring computer 3 can be used to receive the visible digital signals and to analyze and to process the combined signals of the digital visible signals and the digital infrared signals so that it can perform excessive temperature alarm aiming to anomaly and pinpoint the risk location.

The shooting orientation of infrared camera 1 and the CCD cameras 5 changes with the operating of the pan-tilt which is installed with the infrared camera 1 and CCD camera 5. The pan-tilt connects to the said video conversion device 2 through 485 serial port so as to realize the data communication between them.

According to some embodiments of the present application, the system further includes a casing 6 covers the infrared camera 1 and the CCD camera 5 and their internal powers into its shell.

The video conversion device 2 according to some embodiment of the present application further comprising: a network data conversion unit 21 for transforming analog signals from the cameras into standard digital signals for network transmission, wherein, the cameras comprise an infrared camera 1 and a CCD camera 5. The analog signals contain infrared imaging analog signals and visible imaging analog signals while the digital signals encompass infrared digital signals and visible signals; And a pan and tilt control unit 22 for transforming a pan-and-tilt control signals from a network into 485 serial port control signals in order to control a corresponding pan and tilt to operate and to receive the status of the pan and tilt through 485 serial port, and then to transmit these information to a monitoring computer 3.

The monitoring computer 3 according to some embodiments of the present application includes: data input interface 31 for receiving digital signals transiting from the video transforming device 2; and data analysis module 32 for intercepting and analyzing the digital signals from the data input interface by using forest fire disaster analysis and process software and for determining and locating the fire area within the monitored region based on the processed data and for generating the pan and tilt control signals to control the infrared camera 1 and the CCD camera 5.

The monitoring computer 3 further includes: storage module 33 for storing the processed data and the determined conclusion; and display module 34 for directly displaying infrared video pictures, fire triggering places and recommending disposal solutions within the monitoring region.

According to some embodiments of the present application, the data input interface 31 of the monitoring computer 3 transmits the data and realizes network communication with the video transform device 2 through EPON optical chain circuit.

According to some embodiments of the present application, the system further comprises a switcher or HUB 4 for being connected to the video transform device 2 by network cables to achieve the network communication between the two.

The area in the infrared camera monitored forest varies according to different type and parameters of the infrared camera. For example, a monitoring infrared imaging camera with 100 MM aperture can monitor an area of 2 KM in its radius or so. Its single detector pixel approximates 2×2 $m^2$. In addition, the rotation angle of the pan and tilt will also affect the observation scope of the infrared camera. Taking a YS 3081 pan and tilt with a loading capacity of 40 KG for example, while its horizontal rotating angle is approximately 0°~360° (consecutive rotation) and its vertical rotating angle approx. −60°~+60°, then the infrared image monitor with 100 MM aperture can patrol and monitor the scope of area of 2 KM in radius or so.

The reference area S is adjustable with a minimum size to one pixel (2×2 m while the range is longer than 2 KM). The alarm temperature and the temperature difference allowable scope can be set manually. Before the next manual modulation, those values could be constant ones. The scope of temperature measurement value can reach up to its highest range from 0°~2000°, but the general scope would be from 0°~250°.

Figure 5:
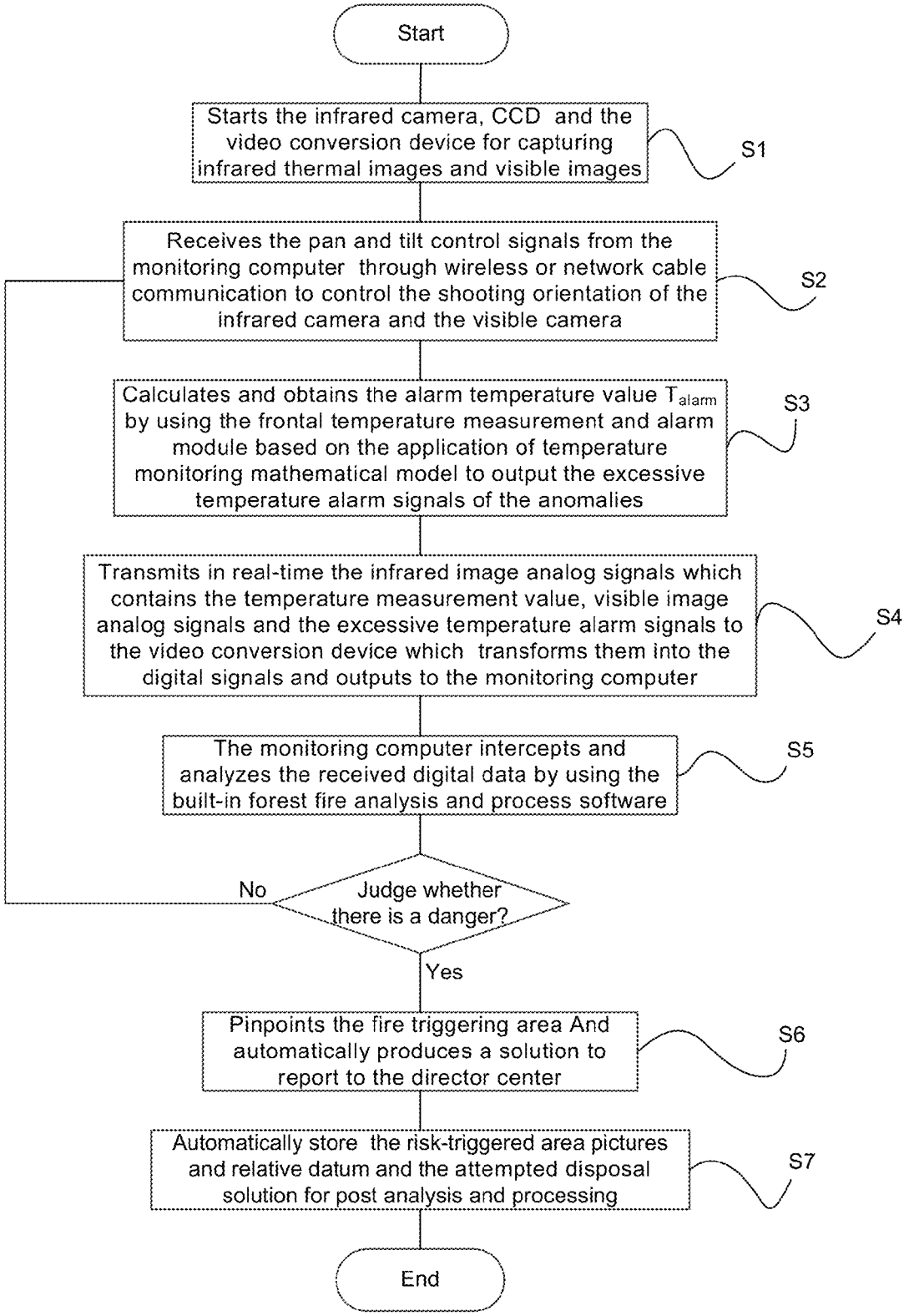
FIG. 5 is a flow chart of a forest fire alarm system according to an embodiment of the present application.

FIG. 5 describes the method for monitoring and alarming of forest fire alarm system according to some embodiments of the present system.

Some embodiments of the present application provide a method for the utilization of a forest fire alarming system. The method includes the below steps:

S1) starts the infrared camera 1, CCD 5 and the video conversion device 2 which are mounted at the woodland commanding heights of area needed the fire early-warning monitoring for capturing infrared thermal images and visible images;

S2) receives the pan and tilt control signals from the monitoring computer 3 through either wireless or network cable communication so as to control the capture orientation of the infrared camera 1 and visible camera 5;

S3) obtains the alarm temperature value $T_{alarm}$ through the calculation by the frontal temperature measurement and alarming module 11 based on the application of temperature monitoring arithmetic model so as to output the over-temperature alarm signals aimed at the anomaly;

S4) transmits in real-time the infrared image analog signals which contains the temperature measurement value T, visible image analog signals as well as the excessive temperature alarm signals to the video conversion device 2 thereon. The video conversion device 2 transforms them into the digital signals and outputs to the monitoring computer 3;

S5) monitoring computer 3 intercepts and analyzes the received digital data utilizing the built-in forest fire analysis and process software;

S6) when receiving the excessive temperature alarm signals, the monitoring computer 3, based on the aforementioned analysis, locates the fire triggering area and alarms on excessive temperature, otherwise, reverses aback to S2.

According to some embodiments of the present application, wherein in step S3, the frontal temperature measurement and alarming module 11, based on its built-in temperature monitor arithmetic module and the temperature measurement value T, computes to determine: preset alarm temperature $T_{set}$. To set a constant value or a variable constant value based on the temperature measurement statistical value of the monitored region and the fire risk temperature statistical value as a preset alarm temperature $T_{set}$; an isothermal allowed width δt either set as a constant temperature difference value or a variable temperature difference value based on both statistical values of temperature measurement and fire temperature in the monitored area; a reference area S which is set based on the monitoring reference of the infrared camera and the install location of which the minimum size of the reference area should be the monitored area of one pixel of the infrared camera while the maximum one the monitored area of full-screen monitoring picture of the infrared camera; and an average temperature of reference area $T_S$ is the average temperature automatically captured within the reference area S based on the monitored pictures of the foregoing reference area S; and a hottest spot temperature $T_h$ is automatically captured based on the real time monitoring pictures of the monitored region and the temperature measurement value T within those pictures, wherein: alarm temperature value $T_{alarm}$=average temperature of the reference area $T_S$+isothermal allowed width δt.

In step S3, the condition for excessive temperature alarm while there is an anomaly is: when the hottest spot temperature value $T_h \geq$alarm temperature value $T_{alarm}$, the frontal temperature measurement and alarm module 11 will alarm on excessive temperature; and when the hottest spot temperature value $T_h \geq$preset alarm temperature value $T_{alarm}$, the frontal temperature measurement and alarm module 11 will alarm on excessive temperature.

According to some embodiments of the present application, the method for alarming forest fire further includes following steps:

After having executed step S7, the monitoring computer 3 will visualize pictures of danger of the monitored area, relative data and the attempted disposal solution which will be automatically stored into the storage module and/or the forest fire analysis treatment software so as to do the post-fire analysis and treatment.

According to some embodiments of the present application, the method for alarming forest fire is characterized as follows:

a. an infrared camera is erected at the apogee of a forest land needed to be monitored and connected with the monitoring computer of the monitored center through wired-network or wireless network;

b. the monitoring computer has a built-in on-line monitoring and forest fire analyzing and processing software with which the monitoring computer can intercept, analyze and display the network-sync-returned infrared video images;

c. the temperature monitoring mathematical module built in the frontal temperature measurement and alarm module adopted the innovative vague methods of computation which preset the function of capturing automatically and displaying the hottest spot $T_h$ of the screen.

In addition to the feature of automatically capturing the hottest spot, a preset temperature alarm value $T_{set}$, an isothermal allowed width δt and a reference area S (the area can be downsized to a spot or expanded to the full screen) can be set manually and intentionally regarding the property setting of the algorithm which can automatically capture and display respectively the hottest spot $T_h$, the lowest spot $T_1$ and the average temperature $T_S$ within the reference area S.

e. The algorithm operates like this: use the average temperature $T_S$ within the reference area S as a parameter for variety, then add the isothermal allowed width δt to gain the temperature alarm value $T_{alarm}$ and present the final value.

f. At any time, when the monitored hottest temperature $T_h$ is higher than the preset alarm temperature value $T_{set}$ or the comparative alarm temperature value $T_{alarm}$, it will elicit an alarm indication.

After the alarm, the system will automatically return a frame of infrared image while alarming to the database of the forest fire analyzing and processing software and generate automatically a solution to the command center in order to implement urgent rescue and to analyze and to process after the alarm issue.

Figure 4:
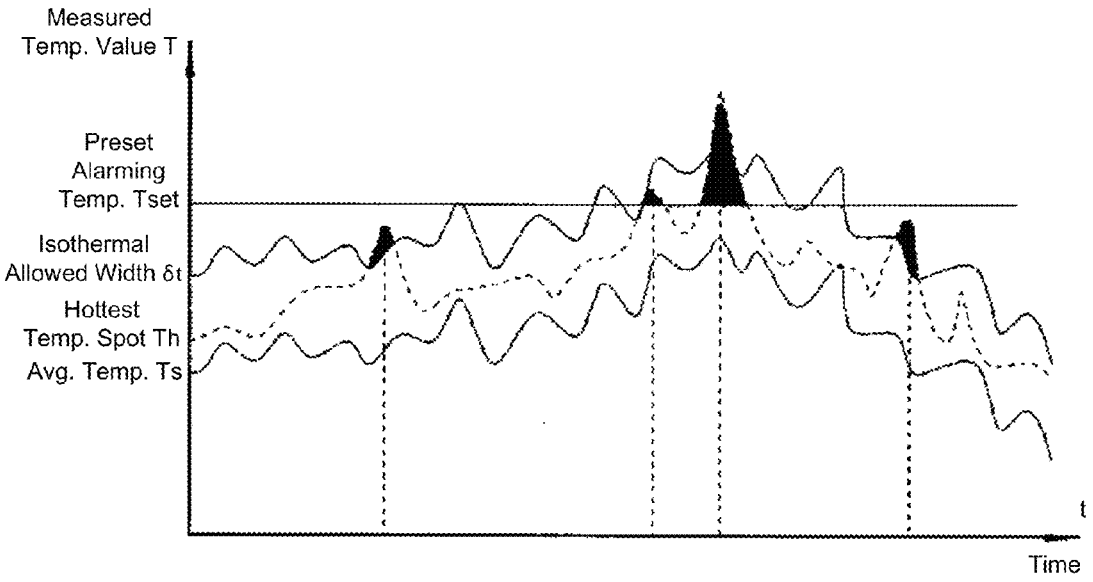
FIG. 4 is a temperature measurement graph of a forest fire alarm system according to an embodiment of the present application.

FIG. 4 shows a temperature measurement curve diagram of some embodiments of the present application of the forest fire alarm system. The changed value of the temperature measurement curve is based on the measured temperature value of latitude, air quality and the weather condition of the monitored region. Wherein, the blackened parts are the four areas which locate inside the scope of excessive temperature alarm of the present application. Once the temperature measurement value T falls into one of the four areas, the frontal temperature measurement and alarm module of the present application will output the excessive temperature alarm signals to the monitoring computer 3. In the state of art, only the middle two areas belong to excessive temperature alarm scope, i.e. the conventional system is unable to identify and to trigger alarm for either side of the danger as in FIG. 4, thus this kind of forest fire precaution method has a big safety problem.

Some embodiments of the present application possess such advantages as below:

1) the present application addresses the problem that it is hard to set the alarm temperature value as a constant figure due to a complex and complicated climate of the monitored forest;

2) the present application put forward a brand new vague algorithm which can automatically adjust the alarm parameter to achieve the goal of automatically alarm at different distance, time and season, which meet the requirement of alarm for monitored forest fire detection;

3) the infrared camera of the system adopts the latest research achievement of SATIR—its frontal temperature measurement and alarm module which can suffice the precision request for distance forest infrared image capturing and temperature measurement and compute the alarm temperature value $T_{alarm}$ needed by monitoring the forest fire through the built-in temperature monitoring mathematical module.

Although embodiments have been described with reference to a number of illustrative embodiments thereof, it should be understood that numerous other modifications and embodiments can be devised by those skilled in the art that will fall within the spirit and scope of the principles of embodiments. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art. The scope of the present invention should, therefore, be determined only by the following claims.

The invention claimed is:

1. A forest fire alarm system based on infrared thermal imaging technology comprising:

an infrared camera located within a monitored area for monitoring and early fire warning in a forest, the infrared camera configured to capture infrared thermal images of said monitored area, and to transmit infrared thermal analog signals which contain temperature measurement values T relating to the infrared thermal images of the monitored area, and wherein the infrared camera includes a frontal temperature measurement and alarm module configured to:

determine a preset alarm temperature $T_{set}$ either set as a constant value or a variable constant value based on both statistical values of the temperature measurement values T and fire temperature in the monitored area;

determine an isothermal allowed width $\delta_t$ either set as a constant temperature difference value or a variable temperature difference value based on both the statistical values of the temperature measurement values T and the fire temperature in the monitored area;

determine an average temperature $T_S$ of a reference area S within the monitored area;

calculate, based on changes of environmental temperature parameters including at least one of distance, temperature difference and alternate seasons, an alarm temperature value $T_{alarm}$ determined as a sum of the average temperature $T_S$ and the isothermal allowed width $\delta_t$; and transmit alarm signals when a hottest temperature spot $T_h$ automatically captured based on the temperature measurement values T exceeds the lower of the alarm temperature $T_{set}$ and the alarm temperature value $T_{alarm}$.

2. The forest fire alarm system according to claim 1, wherein the frontal temperature measurement and alarm module further comprises an alarming unit in which it holds a temperature monitoring mathematical model for calculating, based at least in part on the temperature measurement value T, in order to determine:

the preset alarm temperature $T_{set}$;

the isothermal allowed width δt;

the reference area S set based on the monitoring parameter of the infrared camera and its mounted area, a minimum area of the reference area being the area monitored by a pixel of the infrared camera, while a maximum one being a full-screened area; and the average temperature of the reference area Ts automatically captured from the monitored pictures of the reference area S; and the hottest temperature spot $T_h$ automatically captured based on the real-time monitored pictures of the monitored area and its temperature measurement value T.

3. The forest fire alarm system according to claim 1, further comprising:

a video conversion device connected to the infrared camera and configured to transform the infrared thermal image analog signals transmitted by the infrared camera into infrared digital signals for standard network transmission, and to receive and convert the alarm signals from the infrared camera into alarm digital signals; and a monitoring computer configured to generate and output control signals in order to control the infrared camera, and to receive, analyze and process the infrared digital signals to ascertain a location in the monitored area that triggered an infrared camera alarm based on the alarm digital signals.

4. The forest fire alarm system according to claim 3, wherein, the frontal temperature measurement and alarm module comprises a lens, a detector, and a main board, wherein the main board further comprises a temperature measurement unit and an alarm unit, wherein, the temperature value T is measured by the temperature measurement unit and is transmitted to the alarm unit for calculating the alarm temperature value $T_{alarm}$, the alarm unit configured to output the alarm signals to the video conversion device.

5. The forest fire alarm system according to claim 1, further comprising:

a CCD camera fixed in the vicinity of the infrared camera and configured to capture visible images of the monitored area and to transmit visible image analog signals relating to the visible images of the monitored area, wherein a video conversion device is configured to connect to the CCD camera and transform the visible image analog signals from the CCD camera into visible digital signals which can be transmitted through a standard network; and a monitoring computer is also configured to generate and to output control signals in order to control a plurality of the CCD cameras, and to receive the visible digital signals, and to combine the received visible digital signals and the infrared digital signals for analyzing and processing so as to alarm an anomaly and to ascertain a location where a danger situation is detected.

6. The forest fire alarm system according to claim 5 wherein a shooting orientation of the infrared camera and the CCD cameras changes with the operating of a pan-tilt, which is installed and integrated with the infrared camera and the CCD cameras, wherein the pan-tilt connects to the video conversion device through a 485 serial port to enable data communication between the video conversion device and each of the CCD cameras and the infrared camera.

7. The forest fire alarm system according to the claim 6, wherein the video conversion device further comprises:

a network data conversion unit configured to transform analog signals emitted by the CCD camera and the infrared camera into digital signals for standard network transmission, wherein the cameras contain the infrared camera and the CCD camera while the analog signals include infrared imaging analog signals and visible imaging analog signals, and the digital signals encompass infrared digital signals and visible signals; and a pan and tilt control unit configured to transform pan-and-tilt control signals from a network into 485 serial port control signals in order to control a corresponding pan and tilt to operate and to receive the status of the pan and tilt through the 485 serial port, and to transmit this information to the monitoring computer.

8. The forest fire alarm system according to claim 5, further comprising:

a casing configured to cover the infrared camera and the CCD camera and their internal power devices, which are respectively integrated into the casing.

9. The forest fire alarm system according to claim 6, wherein the monitoring computer comprises:

a data input interface configured to receive digital signals transmitting from the video conversion device; and a data analysis module configured to intercept and analyze the digital signals from the data input interface by using forest fire disaster analysis and process software and to:

determine and locate a fire area within the monitored area based on the analyzed data; and generate the pan and tilt control signals to control the infrared camera and the visible camera.

10. The forest fire alarm system of claim 9, wherein the monitoring computer further comprises:

a storage device configured to store the processed data and the determined fire area; and a display device configured to directly present infrared video pictures, fire triggering places and recommended disposal solutions within the monitored area.

11. The forest fire alarm system of claim 9, wherein the data input interface of the monitoring computer is configured to transmit the data and communicate with the video conversion device through an Ethernet Passive Optical Network (EPON).

12. The forest fire alarm system of claim 1, wherein the frontal temperature measurement and alarm module further comprises an infrared (IR) lens, a an IR detector, and a main board for achieving precise far distance infrared image capture and temperature measurement within the monitored area.

13. The forest fire alarm system of claim 1, wherein the system further comprises a switcher or HUB for being connected to a video conversion device by network cables so as to achieve network communication.

14. A forest fire alarm method based on an infrared imaging technology utilizing a forest fire alarm system, the method comprising:

capturing infrared thermal images of a monitored area with an infrared camera, the infrared thermal images indicating temperature measurement values T;

determining a preset alarm temperature $T_{set}$ either set as a constant value or a variable constant value based on both statistical values of the temperature measurement values T and fire temperature in the monitored area;

determining an isothermal allowed width $\delta_t$ either set as a constant temperature difference value or a variable temperature difference value based on both the statistical values of the temperature measurement values T and the fire temperature in the monitored area;

determining an average temperature $T_S$ of a reference area S within the monitored area;

calculating an alarm temperature value $T_{alarm}$ as a sum of the average temperature Ts and the isothermal allowed width $\delta_t$; and transmitting alarm signals to a monitoring computer when a hottest temperature spot $T_h$ automatically captured based on the temperature measurement values T exceeds the lower of the alarm temperature $T_{set}$ and the alarm temperature value $T_{alarm}$.

15. The forest fire alarm method of claim 14, further comprising transmitting in real time infrared image analog signals indicating the thermal images to the monitoring computer.

16. The forest fire alarm method of claim 14, further comprising receiving pan and tilt control signals from a monitoring computer either wirelessly or through a network cable to control a shooting orientation of the infrared camera.

17. The forest fire alarm method of claim 14, further comprising converting analog signals indicating the infrared thermal images into digital signals.

* * * * *